US005431214A

United States Patent [19]

Ohatake et al.

[11] Patent Number: 5,431,214

[45] Date of Patent: Jul. 11, 1995

[54] APPARATUS FOR CONTINUOUS CASTING

[75] Inventors: Norio Ohatake; Makoto Arase; Yoshitaka Nagai, all of Toyama, Japan

[73] Assignee: Yoshida Kogyo K.K., Tokyo, Japan

[21] Appl. No.: 346,582

[22] Filed: Nov. 30, 1994

Related U.S. Application Data

[63] Continuation of Ser. No. 57,545, May 6, 1993, abandoned.

[30] Foreign Application Priority Data

May 12, 1992 [JP] Japan ..... 4-118681

[51] Int. Cl.[6] ..... B22D 11/04; B22D 11/124

[52] U.S. Cl. ..... 164/444; 164/440

[58] Field of Search ..... 164/486, 487, 490, 440, 164/444

[56] References Cited

U.S. PATENT DOCUMENTS

| | | | |
|---|---|---|---|
| 2,705,353 | 4/1955 | Zeigler | 164/487 |
| 3,439,730 | 4/1969 | Moritz | 164/487 |
| 3,713,479 | 1/1973 | Bryson | 164/444 X |
| 3,713,730 | 4/1973 | Moritz | 164/487 |
| 3,726,336 | 4/1973 | Moritz | 164/440 |
| 3,763,921 | 10/1973 | Behr et al. | 164/487 |
| 4,474,225 | 10/1984 | Yu | 164/487 X |
| 4,993,476 | 2/1991 | Nagai et al. | 164/440 |

FOREIGN PATENT DOCUMENTS

| | | | |
|---|---|---|---|
| 685892 | 2/1967 | Belgium . | |
| 0533133 | 3/1993 | European Pat. Off. . | |
| 1138627 | 6/1957 | France . | |
| 813755 | 9/1951 | Germany | 164/444 |
| 1433021 | 10/1968 | Germany . | |
| 54-122633 | 9/1979 | Japan | 164/444 |
| 61-195745 | 8/1986 | Japan | 164/444 |

OTHER PUBLICATIONS

Abstract of Japanese Patent Publication 62-220248 published Sep. 28, 1987.

*Primary Examiner*—J. Reed Batten, Jr.

*Attorney, Agent, or Firm*—Hill, Steadman & Simpson

[57] ABSTRACT

A cooling mold has first and second water cooling jackets provided inside the mold. A primary cooling water jetting mouth is located at a distance between 15 and 40 mm from the meniscus of the molten metal. A secondary cooling water jetting mouth is located at an interval of 20 to 45 mm between a contact point of a primary jet of cooling water and another contact point of a secondary jet of cooling water on an ingot. The primary and secondary cooling water jetting mouths are respectively set at an angle of 15 to 30 degrees and of 30 to 60 degrees relative to the ingot surface. The primary jet of cooling water from the primary mouth impinges on the molten metal cooled in the cooling mold at a distance from the meniscus to establish a transition boiling zone and a film boiling zone. The secondary jet of cooling water impinges on initial zones of the transition boiling zone and the film boiling zone to break-out a vapor film. A wiper is arranged downstream of the cooling mold to contact a circumferential surface of the ingot to wipe off the cooling water from the cooling mold and impinging on the surface of the ingot. A third cooling water jetting mouth is disposed downstream from the wiper.

1 Claim, 5 Drawing Sheets

APPARATUS FOR CONTINUOUS CASTING

This is a continuation of application Ser. No. 08/057,545, filed May 6, 1993 and now abandoned.

BACKGROUND OF THE INVENTION

1. Field of the Invention

This invention relates to a cooling method and a cooling mold for continuous casting of ingots from molten aluminum, aluminum alloys, or other metals and more particularly to a method of continuous and direct chill casting and a mold for carrying out the direct chill casting method.

2. Description of the Prior Art

In this continuous casting method as shown generally in FIG. 7, a molten metal 13 is injected from a tundish 11 through an orifice plate 15 into a mold 12 which is water-cooled, so that the molten metal 13 is cooled in the mold 12 to cast an ingot 14. The molten metal 13 which is introduced through the orifice plate 15 to the mold 12 is contacted with the wall surface of the mold 12 to form a thin solidified shell and is further cooled and cast with impinging cooling water applied from the mold 12.

In continuous casting, a higher rate of casting is desired to improve the production rate and in order to realize the higher rate of casting, it should be simultaneously required to promote the casting quality such as the surface condition of the ingot by proper cooling.

In high rate casting, when the molten metal is solidified in the cooling mold to form the solid shell, the higher rate of casting requires the greater amount of heat extraction and thereby the larger amount of cooling water. The cooling water is applied from the mold to directly impinge on the high temperature ingot and cool it. However, when the casting rate is increased, since the surface temperature of the ingot becomes higher in a situation of impingement cooling with cooling water, a transition boiling zone and a film boiling zone is produced on the ingot surface and a vapor film which creates an adiabatic phase between the ingot surface and the cooling water is formed thereon. Thus, even if the amount of the cooling water is increased, the cooling water does not effectively function to carry out heat extraction so that the danger of break out increases, and problems such as causing quality defects of the ingot arise. Hence, these problems have been the factors which have considerably reduced the casting stability and the quality stability.

In order to solve these problems, cooling methods have been proposed in which directly impinging cooling water is used in two steps as disclosed for example in Japanese Patent Laid-Open Application 58-212849.

However, in the two step cooling method using the cooling water as disclosed in the above Japanese Patent publication, since the distance between the first cooling zone and the second cooling zone becomes considerably long, that is one-half to two times the diameter of the ingot, the surface of the ingot which has been cooled in the first cooling zone is again heated by the time it reaches the second cooling zone due to heat flow from an internal region of the ingot. Hence, even when a second cooling is carried out, the transition boiling and film boiling phenomena are again produced reducing cooling efficiency. When using high rate casting, this tendency is even more increased which considerably reduces the cooling efficiency.

SUMMARY OF THE INVENTION

It is, therefore, an object of the present invention to provide a novel cooling method and an apparatus for cooling a molten metal to cast an ingot in a continuous casting wherein even when the continuous casting rate is increased, a proper cooling can be carried out without a danger of breakout so as to provide stable casting and a high quality ingot.

The present invention relates to a cooling method for a continuous casting process in which an ingot is continuously withdrawn and cast from a cooling mold while cooling a molten metal in the mold. The cooling method of the present invention comprises a primary direct chill step in which primary cooling water from the cooling mold impinges on the molten metal cooled in contact with the cooling mold at a short distance from the meniscus of the molten metal to establish a transition boiling zone and a film boiling zone, and a secondary direct chill step in which a secondary cooling water impinges on the initial zones of the transition boiling zone and the film boiling zone to break-out a vapor film generated in the initial zones to provoke a nucleate boiling and thereby to produce a firmer solidified shell in the ingot without causing casting cracks, whereby the solidifying ingot is properly and effectively cooled to provide stable high rate casting and high quality ingot.

Preferably, the impinging angle of the primary cooling water impinging against an ingot surface is 15 to 30 degrees and the impinging angle of the secondary cooling water impinging against the ingot surface is 30 to 60 degrees. When the ingot has a diameter of 6 to 9 inches, the primary impinging cooling water from the mold contacts the ingot at a distance L1 of 15 mm to 40 mm from a meniscus which is a starting point of development of solidifying a shell, and the distance L2 between the contact point of the primary impinging cooling water from the mold and the ingot and the other contact point of the secondary impinging cooling water and the ingot in the transition boiling zone and the film boiling zone is preferably 20 mm to 45 mm.

A cooling apparatus for accomplishing the abovementioned cooling method is disposed to surround an orifice plate which is secured to an outlet ejecting a molten metal from a tundish. The continuous casting apparatus includes an annular cooling mold having cooling water jetting mouths in an inner face thereof. The cooling mold comprises water cooling jackets in an inner portion thereof, and primary and secondary cooling water jetting mouths which are disposed at the predetermined distance in the withdrawing direction of the ingot. A wiper made of heat- and wear-resistant material is arranged in front of the cooling mold and is contacted with the whole circumferential surface of the ingot which is withdrawn from the tundish. This wiper serves to wipe off cooling water which is applied from the cooling mold to the ingot surface. A third cooling water jetting mouth is arranged ahead of the wiper.

A cooling mold for accomplishing this cooling method comprises first and second water cooling jackets inside thereof, and a primary cooling water jetting mouth and a secondary cooling water jetting mouth which are disposed at the predetermined distance in the withdrawing direction of an ingot, wherein the primary cooling water jetting mouth is set at an angle of 15 to 30 degrees relative to the ingot surface and the secondary cooling water jetting mouth is set at an angle of 30 to 60 degrees relative to the ingot surface. The primary cooling water jetting mouth has preferably a whole peripheral slit shape, and the secondary cooling water jetting mouth has also a grooved or holed shape.

The present invention will be illustrated in detail with the operation.

Generally in a casting mold, when a cooling water impinges directly on a high temperature ingot to cool it, vapor bubbles or vapor films are produced on the high temperature ingot so that the cooling water coming into contact with the ingot extracts heat from the ingot surface of high temperature.

However, even when the cooling water is impinged on a high temperature ingot of about 600° C. to promote a forced convection heat transfer, the transition boiling zone and the film boiling zone are produced immediately after the cooling water is contacted with the high temperature ingot so that they are coated with a vapor film preventing contact between the cooling water and the ingot surface. In order to prevent the vapor film, even if the amount of the cooling water is increased to improve the cooling effects, there is a limit in this improvement of cooling effects. At the same time, even if the pressure of the cooling water is increased, there is also a limit in the improvement of the cooling efficiency.

On the one hand, the length and the shape of an unsolidified portion of the ingot in the casting process is highly correlated with the cooling water amount, the cooling position and the ingot surface temperature. A hard cooling results in a greater temperature difference between the surface portion and the center portion of the ingot so that the danger of casting cracks increases, and a weaker cooling causes breakout to aggravate the stability of the ingot.

In view of these phenomena, the present invention intends to produce a firm solidified shell by impinging cooling water in a transition boiling zone and a film boiling zone to break out a continuous vapor film produced thereon using the pressure of the cooling water, and to cool the ingot surface with direct cooling water to generate a nucleate boiling so as to provide an efficient cooling without compensating for the reduction of the cooling efficiency in the transition boiling zone and the film boiling zone which are produced on the high temperature surface of the ingot by increasing the amount and pressure of the cooling water.

In a casting of an ingot having a large diameter of 6 to 9 inches, the contacting point of the primary impinging cooling water and a high temperature ingot is situated at a distance L1 of preferably 15 to 40 mm from a meniscus. When the distance L1 is less than 15 mm, the danger of generating the breakout in the start of the casting and breakout due to slight changes of casting conditions during casting is increased. When the distance L1 exceeds 40 mm, the direct cooling with the cooling water is retarded causing surface defects such as bleeding out and external cracks of the ingot surface. The depth of an inverse segregation layer becomes excessive to generate quality defects. It is also favorable to set a distance L2 of 20 to 45 mm between the contacting point of the primary cooling water with the ingot and the other contacting point of the secondary cooling water with the ingot. When the distance L2 exceeds 45 mm, the cooling is retarded increasing the unsolidified length within the ingot which increases the danger of cast cracks.

The cooling water impinging angle relative to the ingot surface is one of the important factors in efficient casting. It is favorable to set the primary cooling water impinging angle at 15 to 30 degrees and a secondary cooling water impinging angle at 30 to 60 degrees. When the primary cooling water impinging angle is set at less than 15 degrees, the distance from the meniscus which is a starting point of development of solidifying a shell is increased causing the bleeding out. When it is set at more than 30 degrees, the cooling water flows inversely at the start of the casting which causes the breakout. It is required to set the secondary cooling water impinging angle at 30 to 60 degrees so as to breakout the vapor film which is generated in the transition boiling zone and the film boiling zone by the primary cooling water.

With respect to the shape of a cooling water jetting mouth which is formed in a cooling mold, the whole periphery of the mold is provided with a slit, groove, or hole type opening. The primary cooling water jetting mouth adopts the slit-shaped opening on the whole inner circumferential surface of the mold to cool uniformly the whole outer periphery of the ingot. The secondary cooling water jetting mouth adopts the grooved or holed opening on the whole periphery of the mold to break out the vapor film which is produced in the transition boiling zone and the film boiling zone.

Further features and advantages of the invention will be apparent from the detailed description below, together with the accompanying drawings.

DESCRIPTION OF THE PRESENTLY PREFERRED EMBODIMENTS

Figure 1:
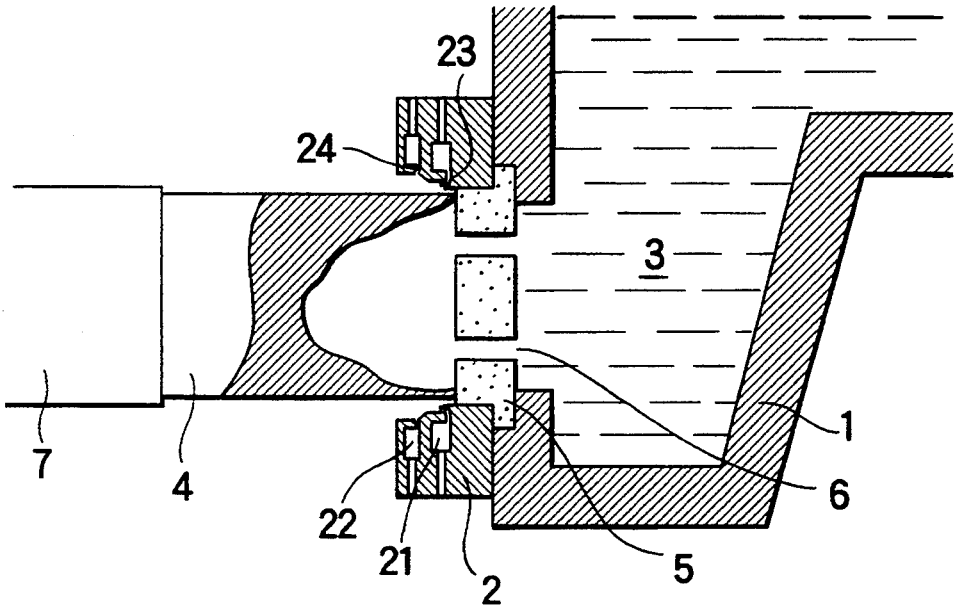
FIG. 1 is a longitudinal sectional view of a cooling portion of a casting mold which shows a cooling situation of a continuous casting process according to the present invention.
Figure 2:
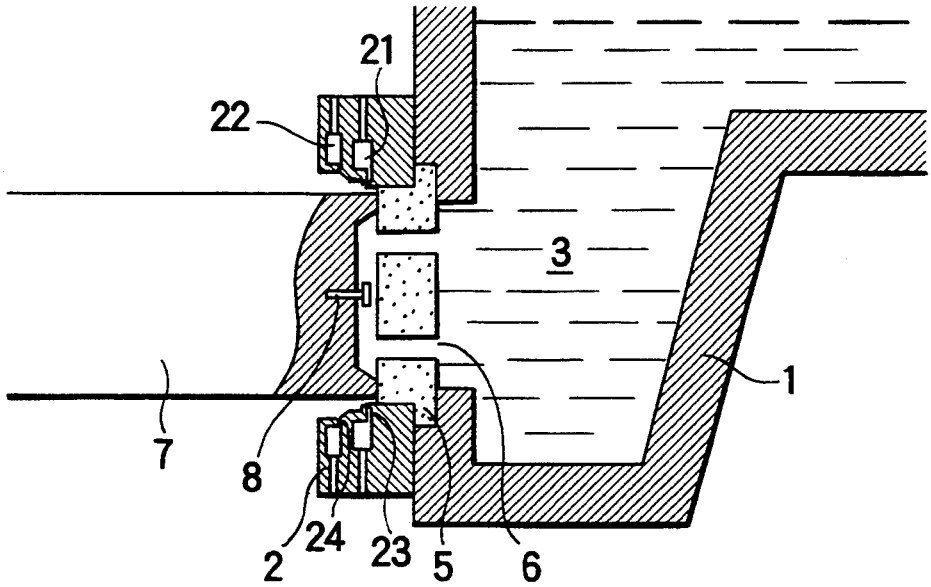
FIG. 2 is longitudinal sectional view of a cooling portion of a casting mold which shows a starting situation of the casting process.
Figure 3:
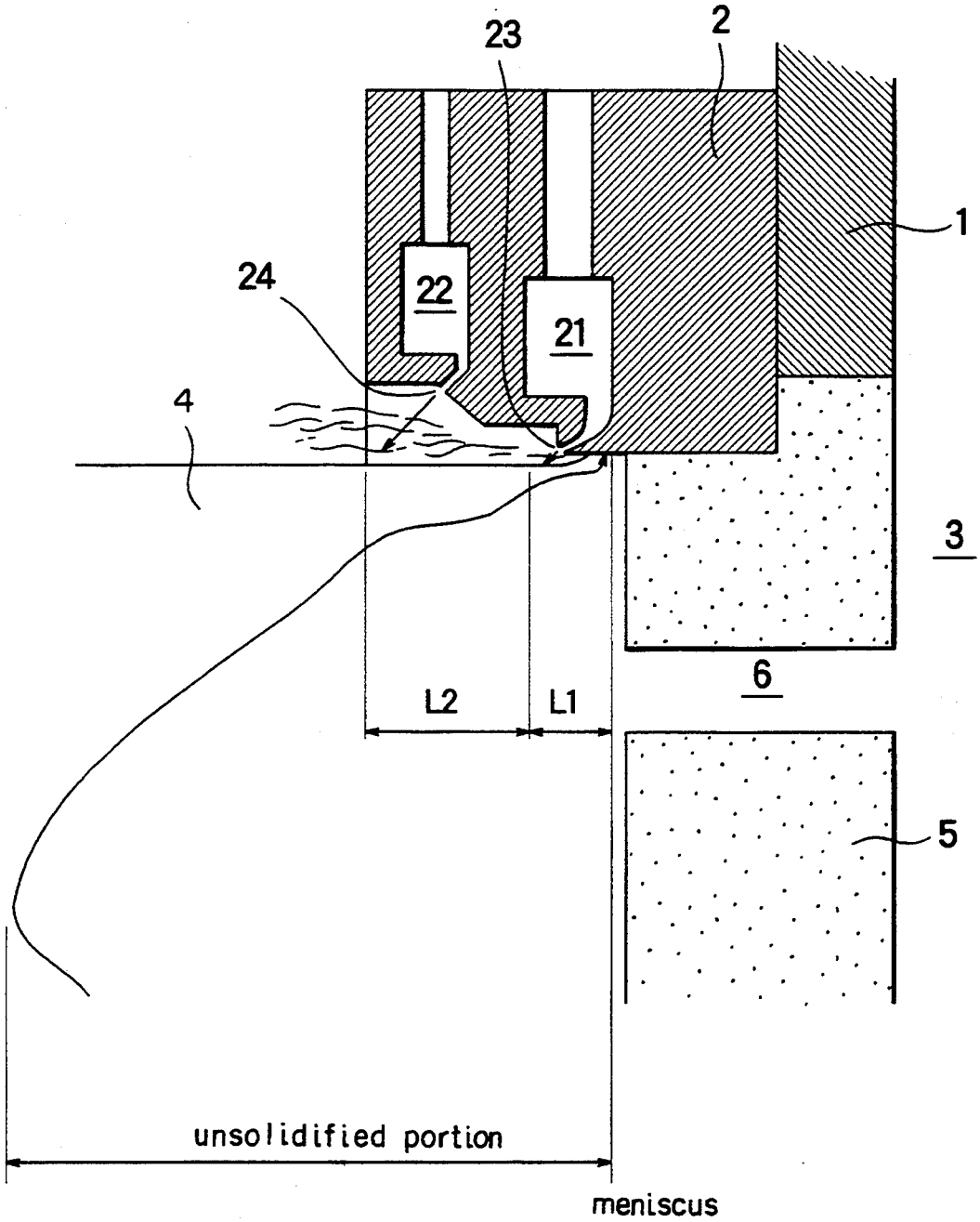
FIG. 3 is partial enlarged view of the cooling portion of the casting mold illustrated in FIG. 1.

A preferred embodiment of the present invention will be illustrated with reference to the accompanying drawings. The present invention is not only usable in a horizontal casting as illustrated herein, but also may be used in a vertical casting. FIG. 1 is a longitudinal sectional view of a cooling portion in the casting, which is a typical embodiment of the present invention. FIG. 2 is a longitudinal sectional view for showing the cooling portion at the start of the casting. And, FIG. 3 is a partially enlarged sectional view of the cooling portion.

In the figures, a tundish, a molten metal, an orifice plate, an orifice, a starting block, and a starting pin are respectively indicated by reference humepals 1, 3, 5, 6, 7, and 8. These members have essentially the same structure as the conventional casting members.

A cooling mold which is disclosed as the essential part of the present invention is indicated by reference numeral 2. First and second ring shaped water cooling jackets 21, 22 are formed in front and rear positions with a predetermined space inbetween on the same axis of the cooling mold. A part of each water cooling jacket 21, 22 communicates with an external cooling water supply pipe. The first and second water cooling jackets 21, 22 are respectively opened on the inner surface of the cooling mold 2 to form individual jet mouth 23, 24. The jet mouth 23 of the first water cooling jacket 21 which is arranged near the tundish 1 is formed with a slit opening on the whole inner circumferential surface of the mold 2. The jet mouth 24 of the second water cooling jacket 22 which is arranged far from the tundish 1 is formed with a grooved or holed opening on the whole inner circumferential surface of the mold 2.

A set position of the jet mouth 23 of the first water cooling jacket 21 is determined by the position in which the cooling water jetted from the jet mouth 23 contacts with the ingot 4. With an ingot having a diameter of 6 to 9 inches, the jet mouth should be set at a position such that the contact point is favorably disposed a distance L1 which is at the distance of 1-5 to 40 mm from the meniscus.

A set position of the mouth 24 of the second water cooling jacket 22 is also determined by a distance L2 between the position where the primary cooling water contacts with the ingot 4 and the other position where the secondary cooling water contacts with the ingot 4. With an ingot having a diameter of 6 to 9 inches, the distance L2 is favorable between 20 and 45 mm.

Moreover, commonly in the first and second water cooling jackets 21 and 22, the cooling water impinging angle against the ingot surface exerts a large influence upon the cooling efficiency. According to the present invention, the angle formed between the impinging cooling water and the ingot surface is preferably set at 15 to 30 degrees in the primary cooling and at 30 to 60 degrees in the secondary cooling.

In the continuous casting with the above-mentioned structure, the starting block 7 is inserted into the cooling mold 2 of the present invention at the start of casting as shown in FIG. 2. The starting pin. 8 secured to the tip of the, starting block 7 is contacted with an end face of the orifice plate 5. In this state, a molten metal is introduced through orifices 6 of the orifice plate 5 into the mold 2, and when the starting block 7 is withdrawn at a predetermined rate from the mold 2, the casting is started.

A plurality of the orifices 6 are formed in the orifice plate 5. The molten metal 3 in the tundish 1 is introduced through the orifices 6 into the cooling mold 2, and since the molten metal 3 is in contact with the inner surface of the mold 2, the surface of the molten metal 3 is cooled to produce a thin solidified shell. Then, the molten metal 3 is directly cooled with a primary cooling water which is jetted from the primary jet mouth 23 of the mold 2 so as to advance the solidification. So, since a transition boiling zone and a film boiling zone are produced on the surface of the ingot 4 by the impingement of the primary cooling water, when a secondary cooling water impinges from the secondary jet mouth 24 of the cooling mold 2 upon the vapor film of these zones, the transition boiling zone and the film boiling zone are broken out by the impinging cooling water to provoke a nucleate boiling, so as to produce a firmer solidified shell in the secondary direct cooling against the ingot surfaces.

The present invention is illustrated in the embodied example wherein an ingot of an aluminum alloy based on Japanese Industrial Standard 6063 is cast by use of a casting apparatus shown in FIG. 1 in the following casting conditions.

(1) The distance L1 between the meniscus and the contact point of the primary jet of cooling water is varied in the following casting conditions to cast the ingot. The results are shown in Table 1.

a. Kinds of alloy: JIS 6063 aluminum alloy
b. Diameter of ingot: 7 inches (178 mm)
c. Casting rate: 350 mm/min
d. Casting temperature: 690° C.
e. Amount of primary jet of cooling water: 85 l/min

TABLE 1

| L 1 | Breakout | Bleeding out; Segregation |
|---|---|---|
| 10 mm | exist | — |
| 15 mm | not exist | slightly |
| 25 mm | not exist | slightly |
| 35 mm | not exist | slightly |
| 40 mm | not exist | a little |
| 45 mm | not exist | much |

(2) The distance L2 between contact points of the primary and secondary impinging cooling water on the ingot is varied in the following casting conditions to cast the ingot. The results are shown in Table 2.

a. Kind of alloy: JIS 6063 aluminum alloy
b. Diameter of ingot: 7 inches
c. Casting rate: 350 mm/min
d. Casting temperature: 690° C.
e. Amount of primary jet of cooling water: 85 l/min
f. Amount of secondary jet of cooling water: 45 l/min
g. Distance between meniscus of molten metal and contact point of primary impinging cooling water: 25 mm

TABLE 2

| L 2 | Nucleate boiling effects | Casting cracks |
|---|---|---|
| 15 mm | small | a little |
| 20 mm | middle | not exist |
| 30 mm | large | not exist |
| 40 mm | large | not exist |
| 45 mm | large | a little |
| 50 mm | middle | a little |

Figure 4:
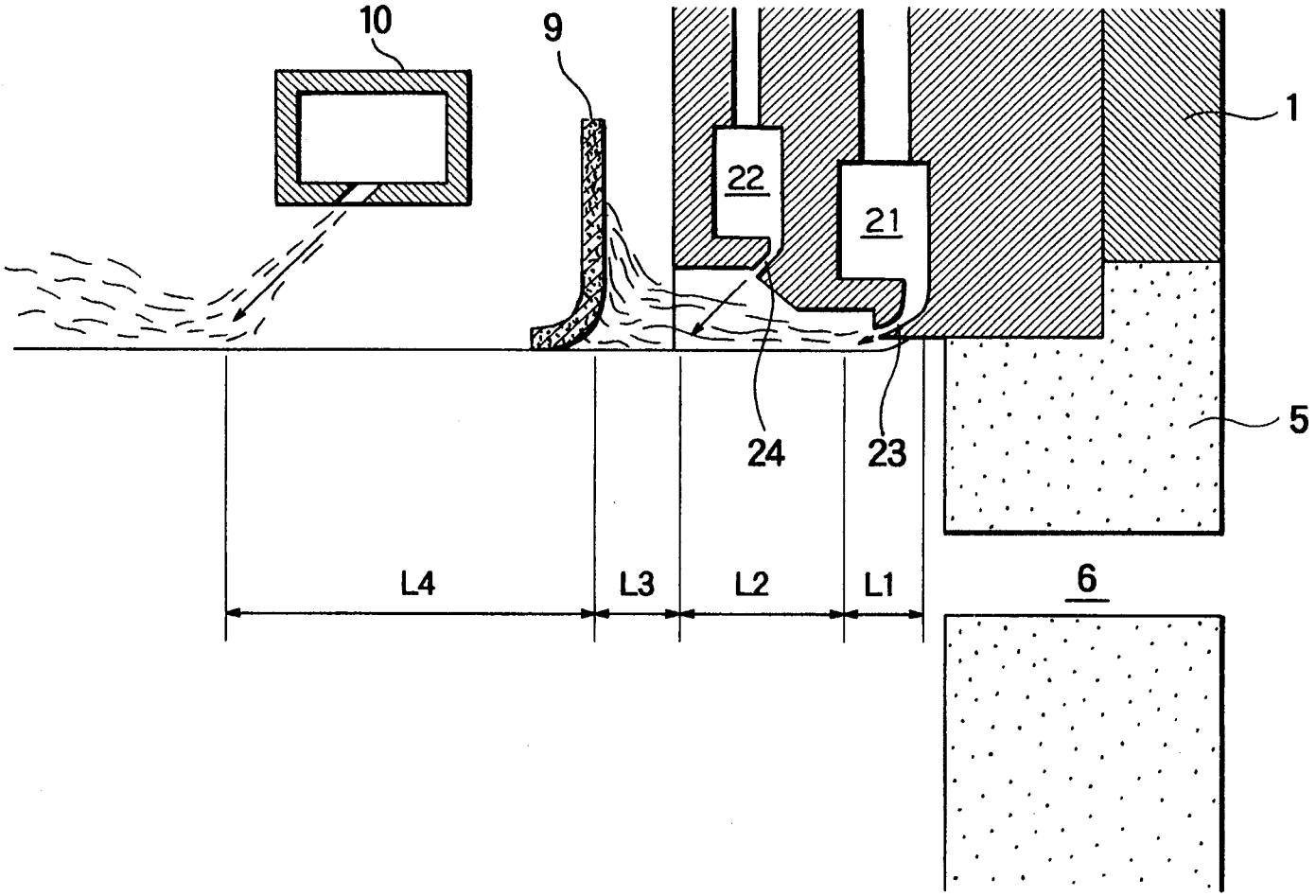
FIG. 4 is a longitudinal sectional view of a cooling portion of a casting mold which shows a cooling state of a continuous casting according to a second embodiment of the present invention.

FIG. 4 shows a second embodiment according to the present invention, in which an annular wiper 9 made of a felt and non-woven fabric of heat- and wear-resistant fiber material such as alamide fiber, carbon fiber and the like or of leather is secured by a non-illustrated frame in front of the cooling mold 2 with the predetermined space L3. The inner diameter of this annular wiper 9 is set to be slightly smaller than the outer diameter of the ingot 4 which is withdrawn from the tundish 1. The first and second impinging cooling water applied from the cooling mold 2 to the surface of the ingot 4 is intercepted by the wiper 9 which functions to wipe it off the surface of the ingot 4.

Moreover, an annular cooling water jetting tube 10 is disposed ahead of the wiper 9 with the predetermined space L4 from the wiper 9 to surround the outer periphery of the ingot 4. The third cooling water is applied from the cooling water jetting tube 10 to the surface of the heat-restored ingot which passed through the wiper 9.

Figure 5:
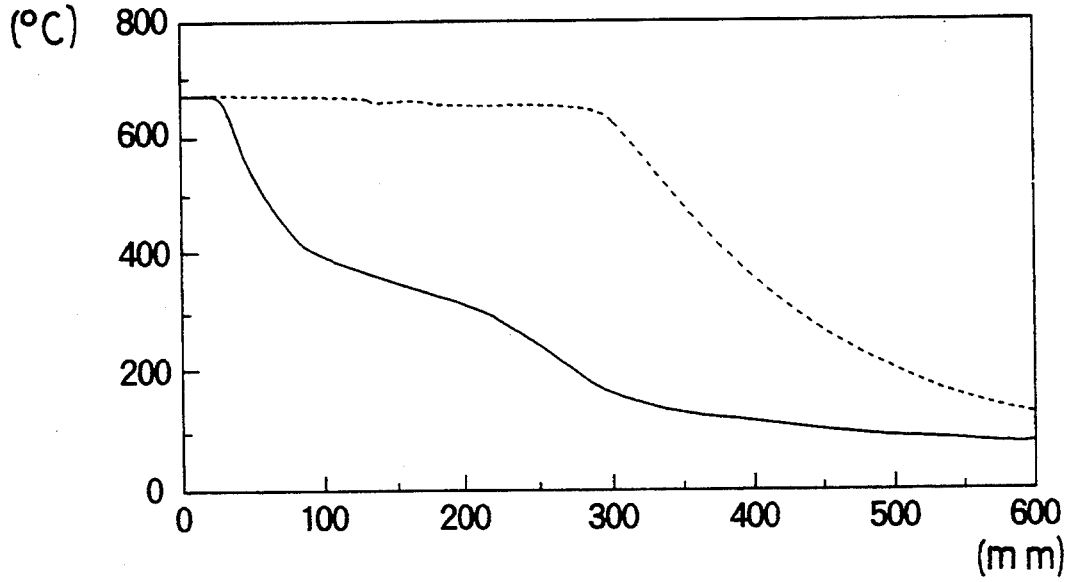
FIG. 5 is an illustrative view which shows the temperature change of the inner and outer portions of an ingot corresponding to the variation of the distance from the meniscus without a wiper and a third cooling water jetting means ahead of the cooling mold according to the present invention.
Figure 6:
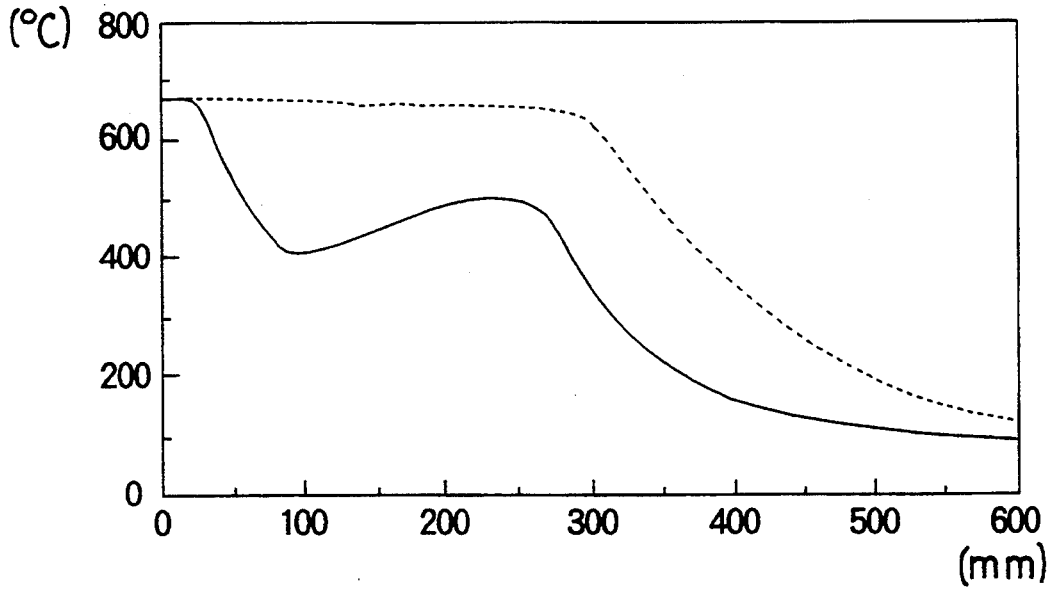
FIG. 6 is an illustrative view which shows the temperature change of the inner and outer portions of an ingot corresponding to the variation of the distance from the meniscus with the wiper and the third cooling water jetting means ahead of the cooling mold according to the present invention.
Figure 7:
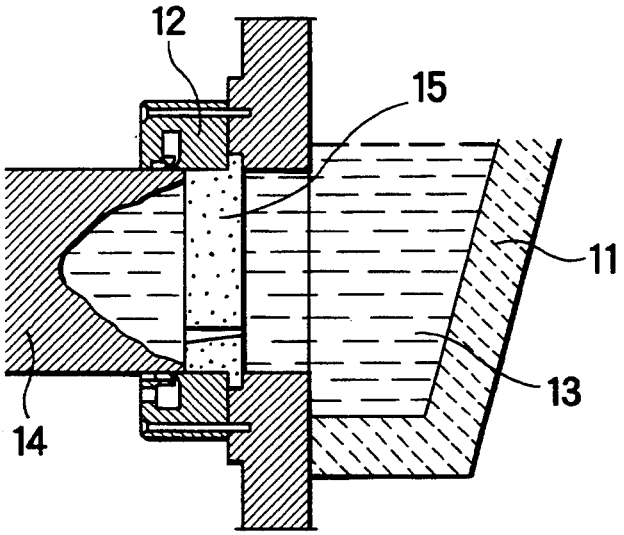
FIG. 7 (PRIOR ART)
FIG. 7 is a longitudinal sectional view of a cooling portion of a casting mold which shows a cooling situation in a conventional continuous casting process.

FIG. 5 and FIG. 6 are graphs showing respectively the temperature change of surface sad center portions of 7 inches diameter ingot (in °C. on the Y-axis) corresponding to the variation of the distance from the meniscus (in mm on the X-axis) in cases of without or with the wiper 9 and the cooling water jetting tube 10. In these figures, the dotted line shows the temperature change in the neighborhood of the ingot surface portion, and the solid line shows the temperature change in the neighborhood of the ingot center portion.

Comparison of both figures shows that without the wiper 9 and the cooling water jetting tube 10, there is a large temperature difference between the surface portion and the center portion of the ingot 4 for the considerably wide range from the meniscus, and in case of setting the wiper 9 and the cooling water jetting tube 10, the surface portion and the center portion of the ingot 4 are gradually cooled with a smaller temperature difference from the location in which the third cooling water is applied to the ingot so as to provide a high quality ingot.

Futhermore, another wiper like the wiper 9 may be provided ahead of the cooling water jetting tube 10 in the above-mentioned second embodiment. In this case, it is possible to reduce the temperature difference between the surface portion and the center portion of the ingot 4 during cooling.

As stated hereinabove, in accordance with the present invention, advantageous results may be obtained as follows:

1. Since a firm solidified shell is produced within a short distance from the meniscus of the molten metal by proper cooling, it is possible to provide a stable high rate casting so as to improve productivity and yield considerably.

2. Since it is possible to provide effective cooling, the amount of cooling water is considerably reduced allowing miniaturization of the cooling water pumping equipment and energy savings.

3. Since powerful cooling is carried out at a short distance from the meniscus, it is possible to prevent surface defects such as bleeding out and the like.

4. Since powerful cooling is carried out in two steps, only a short unsolidified portion is produced in the ingot which prevents internal defects, such as casting cracks and the like.

5. Since an internal composition of the ingot becomes fine with powerful cooling, it is intended to shorten a homogenizing process time, to promote an easy extrusion, and to improve a strength of an extruding material.

It should be understood that various changes and modifications of the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A continuous casting apparatus including an annular cooling casting mold situated to surround an orifice plate secured to an outlet, the outlet allowing egress of a molten metal through the orifice plate from a tundish, the apparatus comprising:

a primary cooling water jetting mouth having an impinging angle between 15 and 30 degrees and a secondary cooling water jetting mouth having an impinging angle between 30 and 60 degrees, the jetting mouths disposed at a predetermined distance in a withdrawing direction of an ingot downstream from the outlet and formed integrally with said mold wherein the predetermined distance of the primary cooling water jetting mouth is between 15 and 40 mm and the predetermined distance of the secondary cooling water jetting mouth is between 20 and 45 mm allowing for withdrawing of the ingot having a diameter between six and nine inches and further wherein the second cooling water jetting mouth is located a greater distance from the outlet than the first cooling water jetting mouth;

a wiper made of heat-and-wear-resistant material arranged downstream from said cooling mold to contact with a circumferential surface of said ingot formed during withdrawal from said mold and to wipe off the cooling water from said cooling mold and impinging on the circumferential surface of said ingot; and a third cooling water jetting mouth disposed downstream from said wiper.

* * * * *